US009598800B2

(12) United States Patent
Lonati et al.

(10) Patent No.: US 9,598,800 B2
(45) Date of Patent: Mar. 21, 2017

(54) KNITTING MACHINE, PARTICULARLY WITH HIGH GAUGE, WITH IMPROVED NEEDLE ACTUATION CAMS

(75) Inventors: Ettore Lonati, Botticino (IT); Fausto Lonati, Brescia (IT); Tiberio Lonati, Brescia (IT); Andrea Lonati, legal representative, Brescia (IT)

(73) Assignee: SANTONI S.P.A., Brescia (IT)

( * ) Notice: Subject to any disclaimer, the term of this patent is extended or adjusted under 35 U.S.C. 154(b) by 139 days.

(21) Appl. No.: 14/345,498

(22) PCT Filed: Sep. 6, 2012

(86) PCT No.: PCT/EP2012/067386

§ 371 (c)(1),
(2), (4) Date: Apr. 11, 2014

(87) PCT Pub. No.: WO2013/041380

PCT Pub. Date: Mar. 28, 2013

(65) Prior Publication Data

US 2015/0128651 A1 May 14, 2015

(30) Foreign Application Priority Data

Sep. 21, 2011 (IT) ..... MI2011A01696

(51) Int. Cl.
*D04B 15/32* (2006.01)
*D04B 15/10* (2006.01)

(52) U.S. Cl.
CPC ..... *D04B 15/322* (2013.01); *D04B 15/10* (2013.01)

(58) Field of Classification Search
CPC ..... D04B 15/10; D04B 15/322; D04B 15/14; D04B 9/00

(Continued)

(56) References Cited

U.S. PATENT DOCUMENTS 1,115,140 A * 10/1914 Williams ..... D04B 15/14 66/115
3,331,218 A * 7/1967 Barth ..... D04B 1/104 66/124

(Continued)

FOREIGN PATENT DOCUMENTS

GB 315055 A * 7/1929 ..... D04B 15/10
GB 1079169 A 8/1967

OTHER PUBLICATIONS

International Search Report and Written Opinion dated Oct. 18, 2012 issued in PCT/EP2012/067386.

*Primary Examiner* — Khoa Huynh
*Assistant Examiner* — Megan Brandon
(74) *Attorney, Agent, or Firm* — Scully, Scott, Murphy & Presser, P.C.

(57) ABSTRACT

A knitting machine, particularly with high gauge, with improved needle actuation cams, comprising a needle holder which supports a plurality of side-by-side needles, each one of the needles is provided with at least one heel that protrudes from one face of the needle holder, each one of the needles has at least one elastic flexing along its extension which determines an offset of its at least one heel with respect to the head of the needle along a direction that is substantially parallel to the actuation trajectory of the needle holder and the at least one path is offset in a substantially corresponding manner, with respect to a theoretical path of actuation of an ideal rectilinear needle with its head in alignment with its at least one heel.

7 Claims, 6 Drawing Sheets

(58) Field of Classification Search
USPC ..... 66/57, 66, 12, 100, 114, 8
See application file for complete search history.

(56) References Cited

U.S. PATENT DOCUMENTS

| | | | | | |
|---|---|---|---|---|---|
| 3,440,838 | A * | 4/1969 | Beckenstein | D04B 15/68 | 66/123 |
| 3,543,280 | A * | 11/1970 | Greczin | D04B 9/44 | 66/115 |
| 3,871,194 | A * | 3/1975 | Greczin | D04B 15/14 | 66/115 |
| 4,041,734 | A * | 8/1977 | Yoichi | D04B 15/10 | 66/115 |
| 4,054,042 | A * | 10/1977 | Durville | D04B 35/04 | 66/123 |
| 4,137,730 | A * | 2/1979 | Bassist | D04B 27/06 | 66/114 |
| 6,223,564 | B1 * | 5/2001 | Lonati | D04B 9/56 | 66/107 |
| 6,609,395 | B2 * | 8/2003 | Ando | D04B 9/10 | 66/57 |
| 6,810,694 | B2 * | 11/2004 | Wallis | D04B 15/50 | 66/146 |
| 7,469,561 | B2 * | 12/2008 | Krauss | D04B 15/10 | 66/115 |
| 8,850,853 | B2 * | 10/2014 | Lonati | D04B 15/10 | 66/114 |
| 2003/0094018 | A1 * | 5/2003 | Sangiacomo | D04B 15/60 | 66/8 |
| 2008/0184745 | A1 * | 8/2008 | Krauss | D04B 15/14 | 66/19 |
| 2009/0314038 | A1 * | 12/2009 | Lonati | D04B 9/02 | 66/111 |
| 2010/0147034 | A1 * | 6/2010 | Stingel | D04B 35/06 | 66/57 |
| 2010/0175428 | A1 * | 7/2010 | Lonati | D04B 15/06 | 66/13 |

* cited by examiner

KNITTING MACHINE, PARTICULARLY WITH HIGH GAUGE, WITH IMPROVED NEEDLE ACTUATION CAMS

The present invention relates to a knitting machine, particularly with high gauge, with improved needle actuation cams.

As is known, knitting machines comprise a needle holder that supports a plurality of needles that are arranged mutually side by side and constitute the elements designed to produce the knitting. The needle holder is provided with means for guiding the needles, which are constituted substantially by a plurality of slots or channels that are arranged mutually side by side along the extension of the needle holder, each accommodating a corresponding needle so that it can slide longitudinally. In single-cylinder or single-bed circular knitting machines, the needle holder is constituted by a cylinder, termed "needle cylinder", and the slots or channels that accommodate the needles are defined axially on the lateral surface of the cylinder. In double-bed circular knitting machines two needle holders are provided, which are constituted respectively by a cylinder, i.e., the needle cylinder, and by a disc, termed "dial", which is arranged above and coaxially to the needle cylinder. In the needle cylinder, the slots or channels that accommodate the needles are defined, similarly to single-bed knitting machines, on the lateral surface of the needle cylinder and run parallel to the axis of the needle cylinder, while in the dial the slots or channels that accommodate the needles are defined inside the dial and extend radially with respect to the axis of the dial that coincides with the needle cylinder axis.

In some machines, the slots or channels are divided, along their longitudinal extension, into two parts, constituted respectively by a knitting forming channel, which is defined proximate to one end of the needle holder, and by a sliding channel, which is defined on the needle holder in a region spaced from the end of the needle holder.

Generally, each needle is accommodated so that it can slide longitudinally inside a corresponding sliding channel aligned with the corresponding knitting forming channel and is provided with a hook-shaped head which can engage at least one thread supplied to the needles at a feed or drop of the machine to form knitting. Each needle is furthermore provided, in a region that is spaced from the head and arranged in the sliding channel, with at least one heel that protrudes from one face of the needle holder and can engage one or more paths defined by cams that face such face of the needle holder.

The needle holder can be actuated with respect to the cams along an actuation trajectory that is substantially perpendicular to the longitudinal extension of the knitting forming channels and the paths are shaped so as to cause, as a consequence of the actuation of the needle holder along this actuation trajectory with respect to the cams, the alternating sliding of the needles along the corresponding knitting forming channel with respect to the needle holder. The alternating sliding of the needles along the corresponding knitting forming channel comprises an extraction motion, during which the needle is extracted with its head and with a portion of its stem from one end of the needle holder in order to release, onto its stem, the loop of knitting formed previously and/or to engage the thread or threads delivered at a feed or drop of the machine, and a retracting motion, by means of which the needle is made to retract with its head into the end of the needle holder to form a new loop of knitting, producing the knockover of the loop of knitting formed previously so as to produce knitting.

If the needle holder is constituted by a cylinder, the needle actuation cams face the lateral surface of the needle cylinder that is actuated with a rotary motion about its own axis with respect to the cams. If instead the needle holder is constituted by a disc-shaped dial, the needle actuation cams generally face the upper face of the dial, which lies on a horizontal plane. In both cases, the needle holder is actuated in relation to the cams along a circular trajectory the center of which is arranged on the axis of the needle cylinder or of the dial.

Italian patent application no. MI2010A-001974 in the name of the same applicant discloses a knitting machine, particularly with high gauge, in which the number of sliding channels is smaller than the number of knitting forming channels. In this case, the portion of the needle that is accommodated inside the sliding channel is axially offset, i.e., laterally offset with respect to the portion of the needle that is accommodated inside the knitting forming channel.

A similar situation can occur also if the number of sliding channels is equal to the number of knitting forming channels but an additional element is arranged inside the sliding channels, laterally to the stem of the needle, causing in any case its axial offset with respect to the portion of the needle that is accommodated inside the knitting forming channel.

This axial offset does not preclude the sliding of the needle in relation to the needle holder for the forming of knitting because the needle, being elastically flexible along its stem, can nevertheless bend and adapt to the non-alignment between the knitting forming channel and the sliding channel in which it is inserted and can slide therein as a consequence of the engagement of its heel with the path or paths defined by the cams.

However, this axial offset can generate drawbacks in forming knitting, because the movement of the head of the needles is early or delayed with respect to an ideal condition of operation, which corresponds to the one that occurs in conventional knitting machines, in which the needles are not bent, i.e., their head is aligned with the heel that engages the actuation cams of the needles.

The early or delayed movement of the head of the needles, by causing an advance or delay with respect to the ideal condition of engagement of the thread or threads delivered to the needles at a feed or drop of the machine, can cause defects in the knitting which penalize the quality of the produced manufacture and in some cases can require its rejection.

The aim of the present invention is to solve the above mentioned problem, by providing a knitting machine, particularly with high gauge, with improved needle actuation cams so as to obtain a precise actuation of the needles even if they have, in the machine, a head that is laterally offset with respect to the heel that engages the actuation cams.

Within this aim, an object of the invention is to provide a knitting machine, particularly with high gauge, capable of producing knitted manufactures of high quality.

Another object of the invention is to provide a knitting machine, particularly with high gauge, that can be manufactured at competitive costs.

This aim and these and other objects that will become better apparent hereinafter are achieved by a knitting machine, comprising a needle holder which supports a plurality of needles arranged side by side and is provided with means for guiding said needles, said guiding means comprising knitting forming channels, which are defined proximate to an end of the needle holder and are mutually laterally adjacent, and sliding channels, which are defined on said needle holder in a region that is spaced from said end of the needle holder and are mutually laterally adjacent; each one of said needles being accommodated, so that it can slide longitudinally, in a corresponding knitting forming channel and being provided, at one of its ends, with a hook-shaped head which can engage at least one thread supplied to the needles at a feed or drop of the machine to form knitting; each one of said needles being provided, in a region that is spaced from said head and is arranged in one of said sliding channels, with at least one heel that protrudes from one face of said needle holder and can engage at least one path defined by cams that face said face of the needle holder; said needle holder being actuatable with respect to said cams along an actuation trajectory that is substantially perpendicular to the longitudinal extension of said knitting forming channels and said paths being shaped so as to cause, following the actuation of the needle holder along said actuation trajectory with respect to said cams, the alternating sliding of the needles along the corresponding knitting forming channel with respect to said needle holder with an extraction motion, by means of which the needle is extracted with its head and with a portion of its stem from said end of the needle holder to release, onto its stem, the loop of knitting formed previously and/or to engage the thread or threads delivered at a feed or drop of the machine, and with a retracting motion, by means of which the needle is made to retract with its head in said end of the needle holder to form a new loop of knitting, producing the knockover of the loop of knitting formed previously to produce knitting, characterized in that each one of said needles has at least one elastic flexing along its extension which determines an offset of said at least one heel with respect to the head of said needle along a direction that is substantially parallel to said actuation trajectory of the needle holder with respect to said cams in the same direction or in the opposite direction to the direction of actuation of the needle holder with respect to said cams, and in that said at least one path is offset, in a manner that corresponds substantially to said offset, with respect to a theoretical path of actuation of an ideal rectilinear needle with its head in alignment with its at least one heel.

Further characteristics and advantages of the invention will become better apparent from the description of a preferred but not exclusive embodiment of the machine according to the invention, illustrated by way of non-limiting example in the accompanying drawings, wherein.

Figure 1:
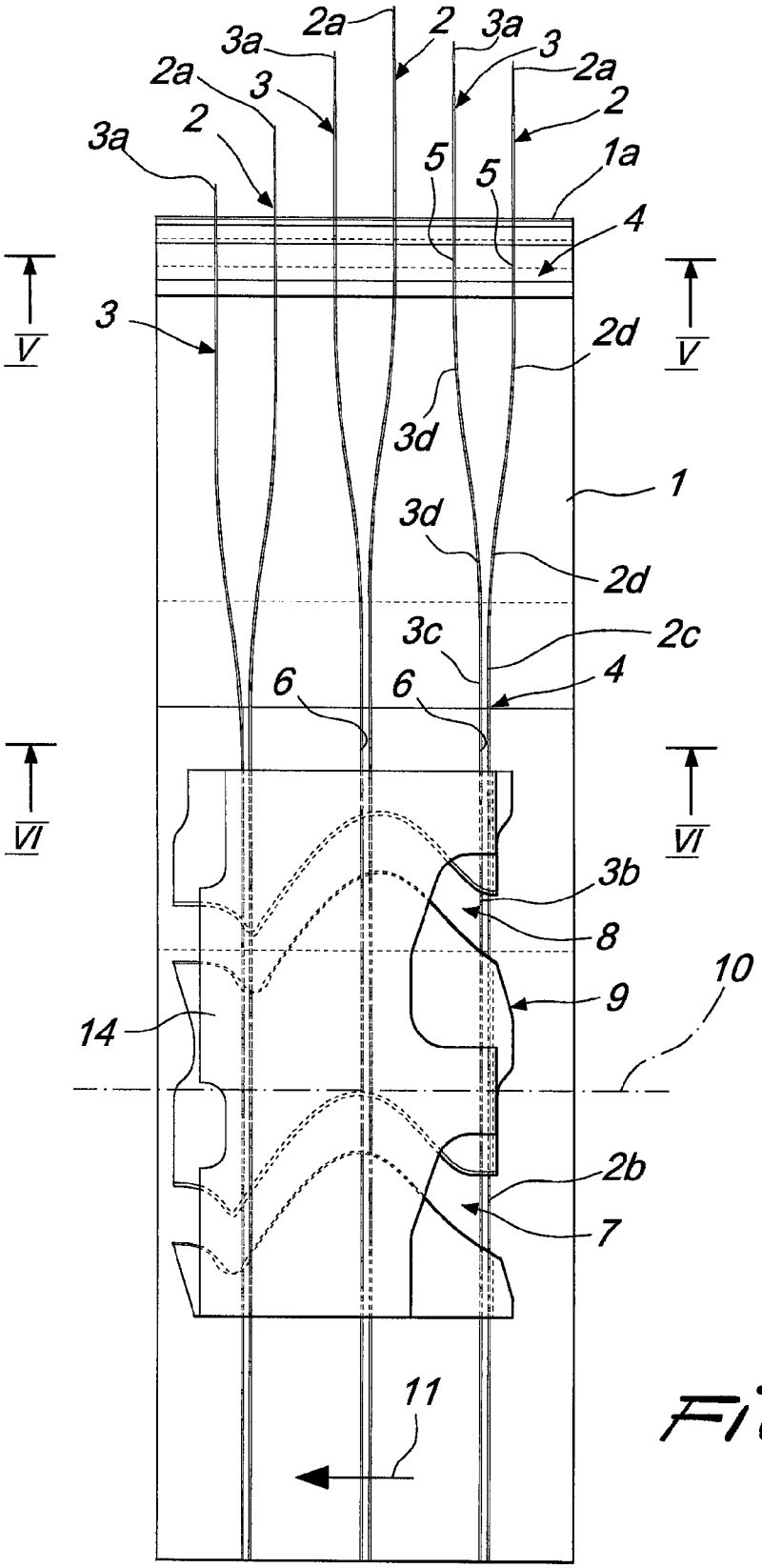
FIG. 1 is a partially sectional schematic front view of a portion of a needle holder of the machine according to the invention.
Figure 2:
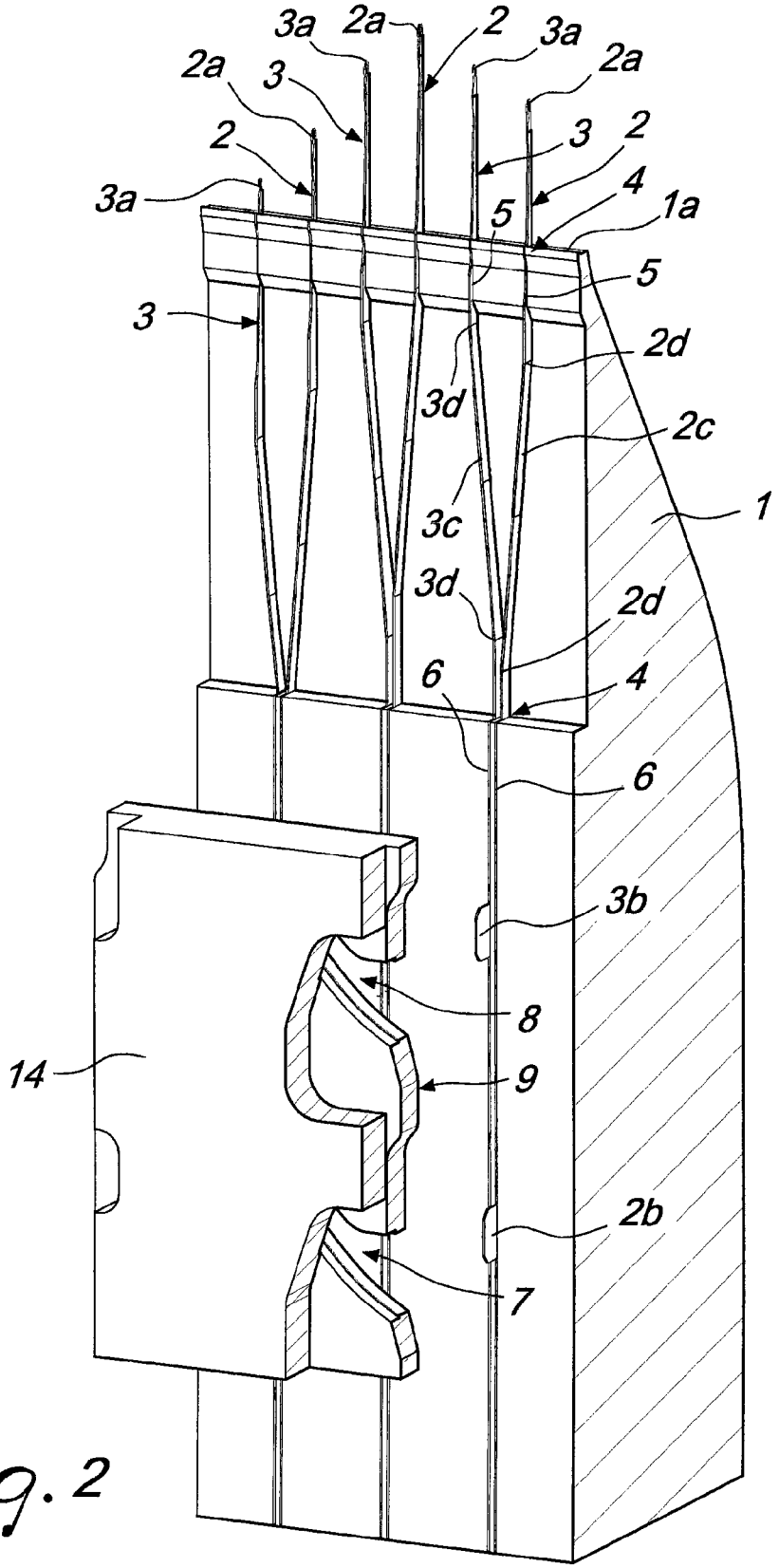
FIG. 2 is a partially sectional perspective view of the same portion of FIG. 1, with the cams spaced from the needle holder for greater clarity.
Figure 3:
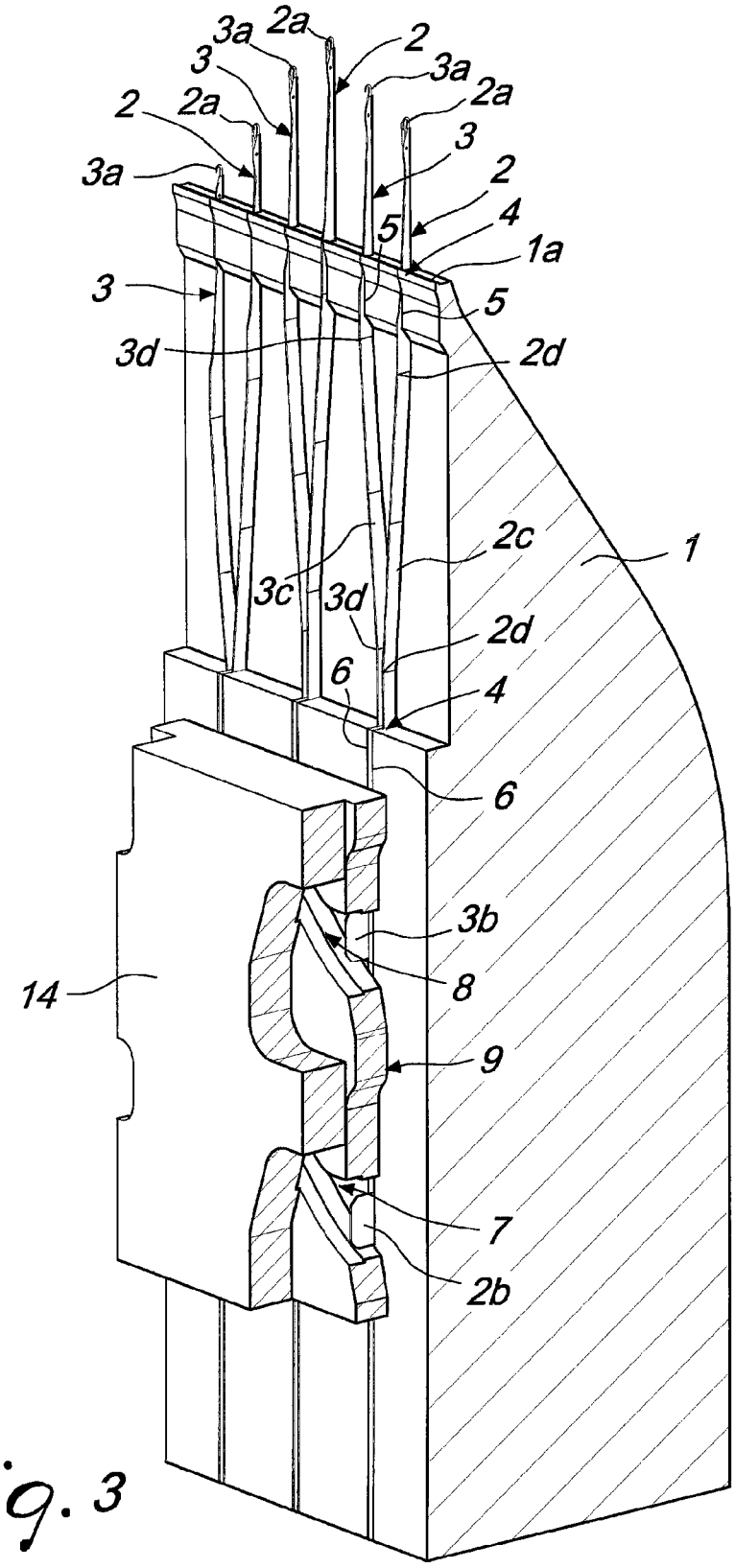
FIG. 3 is another partially sectional perspective view of the portion of FIG. 1, taken from a different angle than FIG. 2 and with the cams in their real position.

With reference to the figures, the machine according to the invention, only a portion of which has been illustrated, comprises a needle holder 1 which supports a plurality of needles 2, 3 arranged side by side and is provided with means 4 for guiding the needles 2, 3.

The guiding means 4 comprise knitting forming channels 5, which are defined proximate to an end 1*a* of the needle holder 1 and are mutually laterally adjacent, and sliding channels 6, which are mutually laterally adjacent and are defined on the needle holder 1 in a region that is spaced from the end 1*a* of the needle holder 1.

Each one of the needles 2, 3 is accommodated, so that it can slide longitudinally, in a corresponding knitting forming channel 5 and is provided, at one of its ends, with a head 2*a*, 3*a* that is hook-shaped and can engage at least one thread supplied to the needles 2, 3 at a feed or drop of the machine to form knitting, in a per se known manner.

Each one of the needles 2, 3 is provided, in a region that is spaced from the head 2*a*, 3*a* and is arranged in one of the sliding channels 6, with at least one heel 2*b*, 3*b* that protrudes from a face of the needle holder 1 and can engage at least one path 7, 8 defined by cams 9 that face the face of the needle holder 1.

The needle holder 1 can be actuated with respect to the cams 9 along an actuation trajectory 10 that is substantially perpendicular to the longitudinal extension of the knitting forming channels 5 and the path or paths 7, 8 are shaped so as to cause, following the actuation of the needle holder 1 along the actuation trajectory 10 with respect to the cams 9, the alternating sliding of the needles 2, 3 along the corresponding knitting forming channel 5 with respect to the needle holder 1 with an extraction motion, by means of which the needle 2, 3 is extracted with its head 2*a*, 3*a* and with a portion of its stem 2*c*, 3*c* from the end la of the needle holder 1 to release, onto its stem 2*c*, 3*c*, the loop of knitting formed previously and/or to engage the thread or threads delivered at a feed or drop of the machine, and with a retracting motion, by means of which the needle 2, 3 is made to retract with its head 2*a*, 3*a* in the end la of the needle holder 1 in order to form a new loop of knitting, producing the knockover of the loop of knitting formed previously to produce knitting.

In the illustrated embodiment, the needle holder 1 is constituted by the needle cylinder of a medium- or large-diameter circular knitting machine The knitting forming channels 5 are each oriented parallel to the axis of the needle cylinder, which is arranged vertically, and are defined on the lateral surface of the needle cylinder starting from the upper end 1*a* of the needle cylinder. The actuation trajectory 10 of the needle cylinder in relation to the cams 9 is a circular trajectory centered on the axis of the needle cylinder and intersects at right angles the axes of each knitting forming channel 5.

The sliding channels 6 also are defined on the lateral surface of the needle cylinder, but in a region that is spaced in a lower region with respect to the region in which the knitting forming channels 5 are defined.

Figure 4:
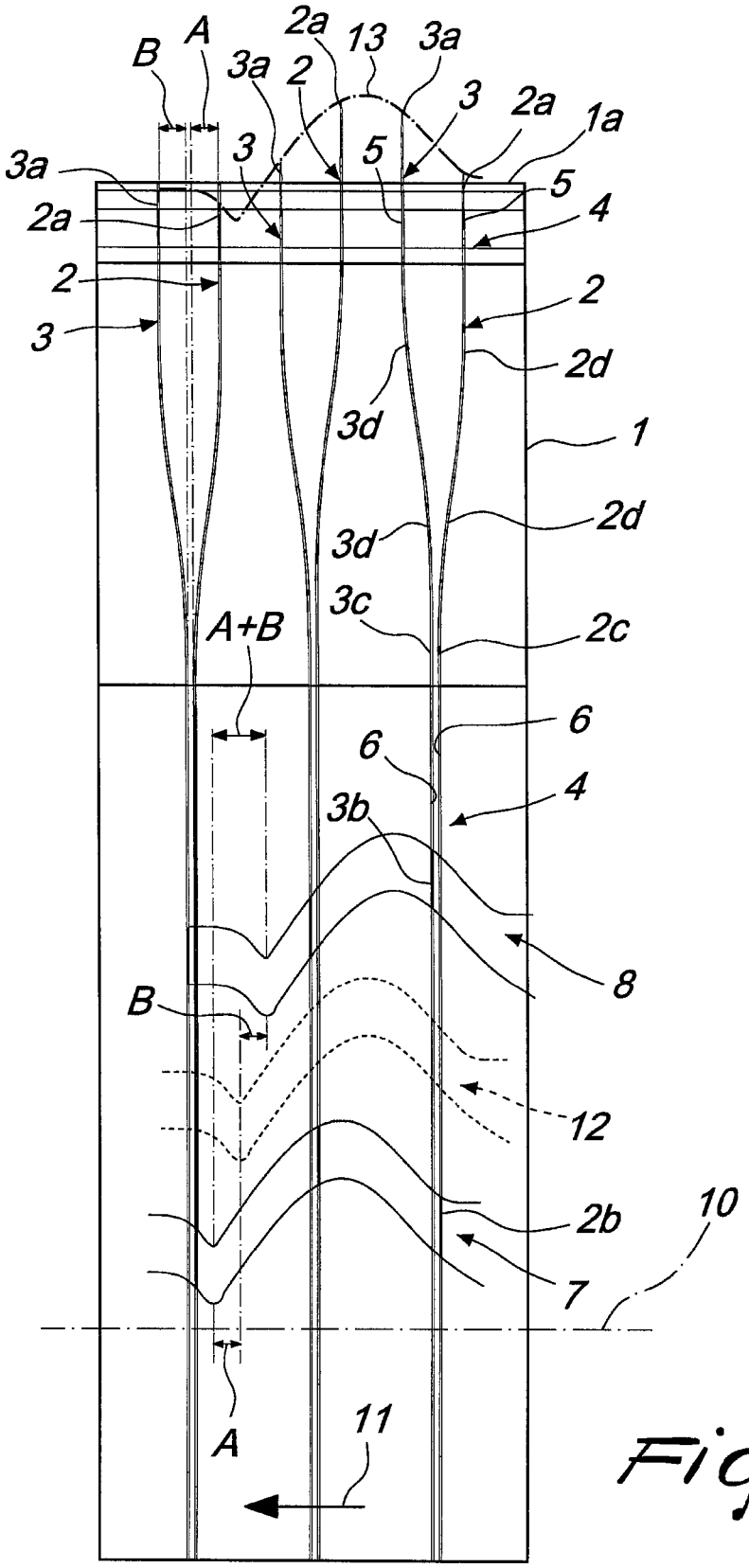
FIG. 4 is a schematic front view of the paths of the heels and heads of some needles accommodated in a portion of the needle holder of the machine according to the invention.
Figure 5:
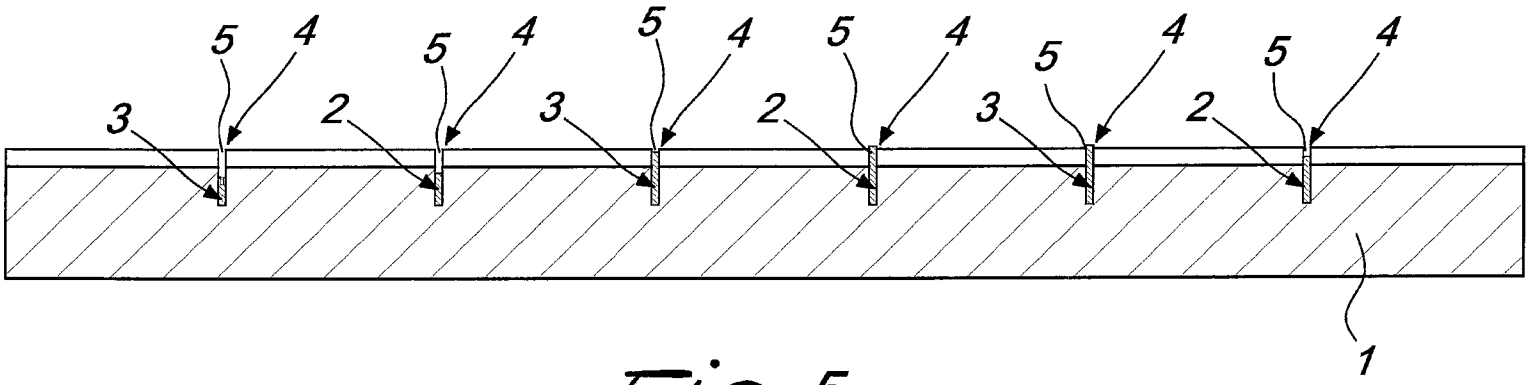
FIG. 5 is a schematic sectional view of FIG. 1, taken along the line V-V.
Figure 6:
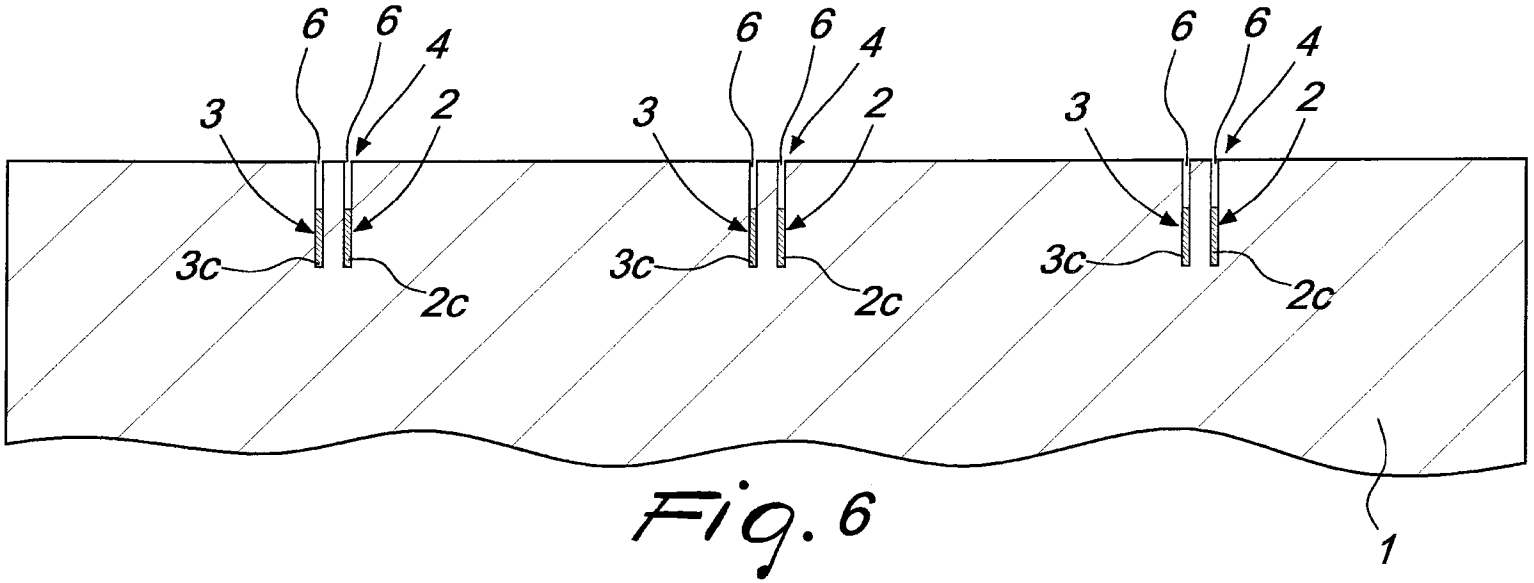
FIG. 6 is a schematic sectional view of FIG. 1, taken along the line VI-VI.

According to the invention, each one of the needles 2, 3 has at least one elastic flexing 2*d*, 3*d* along its extension which determines an offset of the heel 2*b*, 3*b* with respect to the head 2*a*, 3*a* of the needle 2, 3 along a direction that is substantially parallel to the actuation trajectory 10 of the needle holder 1 with respect to the cams 9 in the same direction as, or in the opposite direction to, the direction of actuation of the needle holder 1, designated by the arrow 11, with respect to the cams 9. The path or the paths 7, 8 with which the heel 2*b*, 3*b* of the needles 2, 3 engages is offset, in a manner that corresponds substantially to the offset, with respect to a theoretical path 12 for actuating an ideal rectilinear needle whose head is aligned with the heel. In FIG. 4 the theoretical path 12 is illustrated with a broken line and, for the sake of convenience of comparison, it has been arranged between the paths 7 and 8, as if it had to actuate an ideal rectilinear needle that has a heel arranged in an intermediate position with respect to the one of the heels 2*b*, 3*b* along the stem of the needle.

In the illustrated embodiment, each needle 2, 3 has, along its stem 2*c*, 3*c*, two opposite elastic flexings 2*d*, 3*d*, determined by the coupling of the needle 2, 3 in the corresponding sliding channel 6, which is axially offset with respect to the corresponding knitting forming channel 5. In this manner, the end portion of each needle 2, 3 proximate to the head 2*a*, 3*a* is parallel and spaced laterally with respect to the portion of the stem 2*c*, 3*c* from which the heel 2*b*, 3*b* extends.

The elastic flexing of the needle 2, 3 derives from the fact that the sliding channel 6 in which the needle 2, 3 is accommodated is axially offset with respect to the knitting forming channel 5 in which the needle 2, 3 is arranged. This axial offset can derive from the fact that the number of sliding channels 6 is smaller than the number of knitting forming channels 5, as disclosed in patent application no. MI2010A-001974, or can derive from the fact that the sliding channels 6, despite being equal in number to the knitting forming channels 5, are distributed on the needle holder 1 with a different pitch than the one of the knitting forming channels 5.

In the figures, the degree of offset between the heel 2*b*, 3*b* and the head 2*a*, 3*a* of the needle 2, 3 and consequently the degree of offset between the paths 7 and 8 have been exaggerated intentionally with respect to reality so as to better point out, visually as well, the concept on which the invention is based.

Conveniently, two contiguous needles, designated by the reference numerals 2, 3, which are inserted in two contiguous knitting forming channels 5, have their corresponding heels 2*b*, 3*b* mutually spaced parallel to their longitudinal extension. The heels 2*b*, 3*b* can engage corresponding paths 7, 8, which are defined by the cams 9 and are mutually spaced along a direction that is substantially perpendicular to the actuation trajectory 10 of the needle holder 1 with respect to the cams 9, i.e., parallel to the axis of the needle cylinder in the illustrated embodiment.

Preferably, the two contiguous needles 2, 3, which are inserted in two contiguous knitting forming channels 5, have heels 2*b*, 3*b* that are offset with respect to the corresponding head 2*a*, 3*a* respectively in the same direction as the actuation direction 11 of the needle holder 1 with respect to the cams 9 and in the opposite direction with respect to the actuation direction 11 of the needle holder 1 with respect to the cams 9.

In practice, two contiguous needles 2, 3 are arranged and engaged with the guiding means 4 so as to bend in a different manner with respect to each other and each one of the needles 2, 3 engages a corresponding path 7, 8 defined by the cams 9. Each path 7, 8 is offset with respect to the theoretical path 12 in a manner that corresponds to the offset that exists between the heel 2*b*, 3*b* and the head 2*a*, 3*a* of the needle 2, 3 that engages it.

In the illustrated embodiment, the needles designated by the reference numeral 2 have their heel 2*b* offset with respect to their head 2*a* in the same direction as the actuation direction 11 of the needle holder 1 with respect to the cams 9 by a length designated by A. The needles that are designated instead by the reference numeral 3 have their heel 3*b* offset with respect to their head 3*a* in the opposite direction with respect to the actuation direction 11 of the needle holder 1 with respect to the cams 9 by a length designated by B. The offset that exists between the path 7, with which the heels 2*b* of the needles 2 are engaged, and the theoretical path 12 is equal to A, while the offset that exists between the path 8, with which the heels 3*b* of the needles 3 engage, and the theoretical path 12 is equal to B, but in the opposite direction with respect to the offset A. In this manner, the path 7 is offset with respect to the path 8 by an extent equal to A+B, as shown in FIG. 4.

Due to the offsets of the paths 7, 8 with respect to the theoretical path 12, the axial offsets between the head 2*a*, 3*a* and the heel 2*b*, 3*b* of a same needle 2, 3 are compensated and one obtains an actuation of the head 2*a*, 3*a* of the needles equal to the actuation that one would have with ideal needles whose head is aligned with the corresponding heel engaged with the theoretical path 12. The path of the heads 2*a*, 3*a* of the needles 2, 3 is illustrated in FIG. 4 and designated by the reference numeral 13.

It should be noted that the basic concept of the invention can be extended by providing the needles with the capability to undergo mutually different elastic flexings. Essentially, in the illustrated embodiment, there are two types of needle 2, 3 that have their heel 2*b*, 3*b* offset respectively on one side and on the opposite side with respect to the head 2*a*, 3*a*, but one might have multiple types of needles with different offsets, which are offset also on the same side as the corresponding head but with mutually different degrees of offset, providing for each type of needle a corresponding path for the heels which is correspondingly offset with respect to the theoretical path 12.

Figure 8:
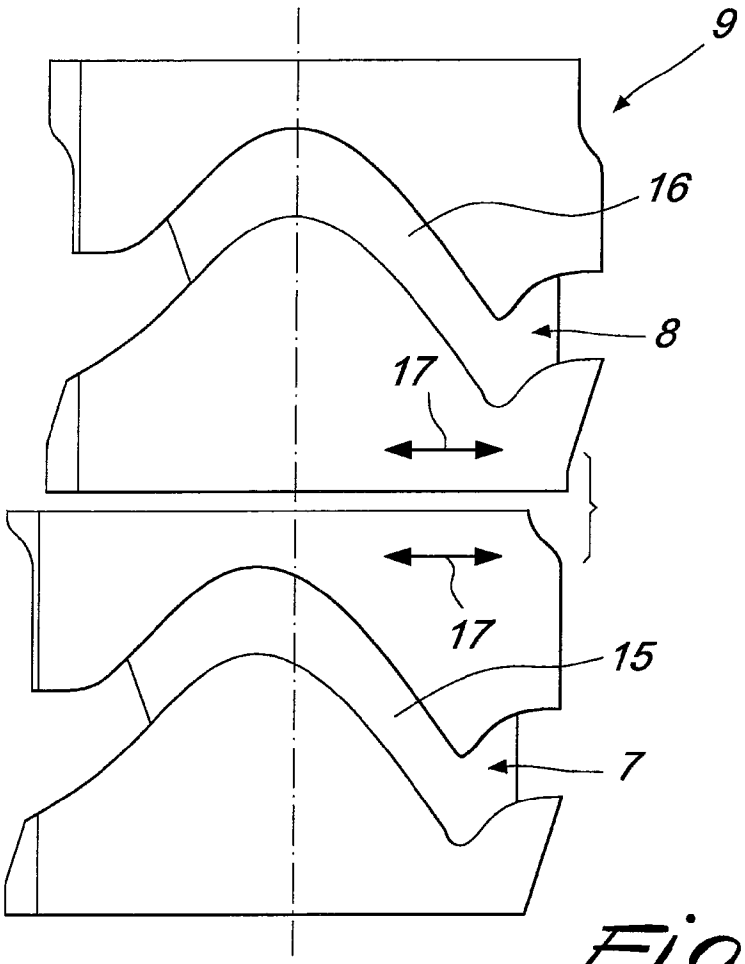
FIGS. 7 and 8 are views of two possible embodiments of a portion of the needle actuation cams, taken from their side facing the needle holder.
Figure 7:
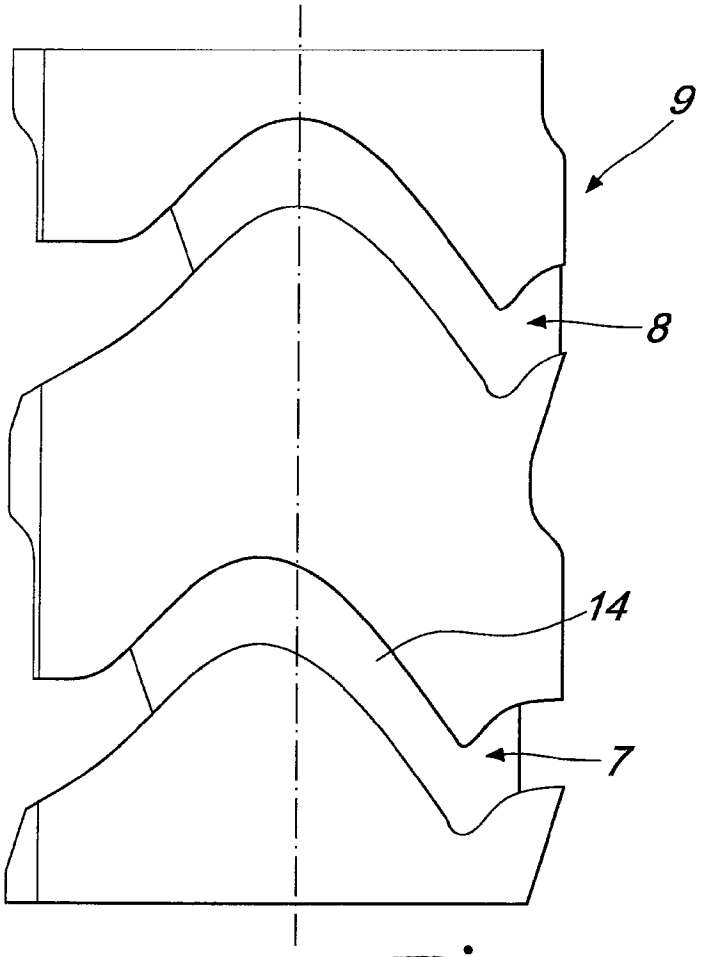

The cams 9 that define the paths 7, 8 can be associated with a fixed support or can be mounted on supporting elements that can move with respect to the remaining part of the cams 9 or the supporting structure of the machine In FIG. 7, the cams 9 that define the paths 7, 8 are fixed to a single supporting element 14, which can be of the fixed or movable type, while in FIG. 8 the cams 9 that define the path 7 are mounted on one supporting element 15 and the cams 9 that define the paths 8 are mounted on another supporting element 16. The two supporting elements 15, 16 can move integrally with respect to each other or relative to each other so as to vary the mutual position of the paths 7, 8 along a direction 17 that is parallel to the actuation trajectory 10 of the needle holder 1 with respect to the cams 9, in order to make it possible to adjust the degree of offset between the paths 7 and 8 and/or in order to allow the mounting of a same group of cams 9 on machines that have needles with different degrees of flexing.

In the illustrated embodiment, the needle holder 1 is constituted by a cylinder, but the basic concept of the invention can be applied also to the dial of a double-bed circular knitting machine. In this case, the knitting forming channels and the sliding channels, instead of being mutually parallel, will be oriented radially with respect to the axis of the dial. For this reason, the cams that define the paths with which the heels of the needles engage, instead of being arranged according to a cylindrical surface, will be arranged according to a planar surface and will face a face, generally the upper face, of the dial from which the heels of the needles protrude.

The invention can be applied also to rectilinear machines in which the needle holder has a substantially planar face in which the knitting forming channels and the sliding channels, which are arranged side by side so as to be mutually parallel, are provided. In these machines, the cams that define the paths with which the heels of the needles engage, which protrude from such face of the needle holder, face this face of the needle holder. In this case, the cams will be movable, with an alternating movement, in relation to the needle holder along a rectilinear trajectory at right angles to the longitudinal axes of the knitting forming channels.

Moreover, the invention can be applied both to machines with knockover sinkers and to machines without knockover sinkers.

In practice it has been found that the knitting machine according to the invention fully achieves the intended aim, since it makes it possible to obtain a precise actuation of the needles that corresponds to the actuation of straight needles, although it uses needles in which the head is laterally offset with respect to the heel.

The machine thus conceived is susceptible of numerous modifications and variations, all of which are within the scope of the appended claims. All the details may further be replaced with other technically equivalent elements.

In practice, the materials used, as well as the dimensions, may be any according to requirements and to the state of the art.

The disclosures in Italian Patent Application No. MI2011A001696 from which this application claims priority are incorporated herein by reference.

The invention claimed is:

1. A knitting machine, comprising a needle holder which supports a plurality of side-by-side needles and is provided with means for guiding said needles, said guiding means comprising knitting forming channels, which are defined proximate to an end of the needle holder and are mutually laterally adjacent, and sliding channels, which are defined on said needle holder in a region that is spaced from said end of the needle holder and are mutually laterally adjacent; each one of said needles being accommodated, so that it can slide longitudinally, in a corresponding knitting forming channel and being provided, at one of its ends, with a hook-shaped head which can engage at least one thread supplied to the needles at a feed or drop of the machine to form knitting; each one of said needles being provided, in a region that is spaced from said head and is arranged in one of said sliding channels, with at least one heel that protrudes from one face of said needle holder and can engage at least one path defined by cams that face said face of the needle holder; said needle holder configured to be actuatable along an actuation trajectory, said actuation trajectory with respect to said cams being substantially perpendicular to the longitudinal extension of said knitting forming channels and said paths being shaped so as to cause, following the actuation of the needle holder along said actuation trajectory, the alternating sliding of the needles along the corresponding knitting forming channel with respect to said needle holder with an extraction motion, by means of which the needle is extracted with its head and with a portion of its stem from said end of the needle holder to release, onto its stem, the loop of knitting formed previously and/or to engage the thread or threads delivered at a feed or drop of the machine, and with a retracting motion, by means of which the needle is made to retract with its head in said end of the needle holder to form a new loop of knitting, producing the knockover of the loop of knitting formed previously to produce knitting, wherein each one of said needles has a first section and a second section, and wherein there is an elastic flexing disposed between said first section and said second section such that each of said needles elastically flexes at said elastic flexing, wherein each one of said needles elastically flexes at said elastic flexing a distance between said first section and said second section, wherein said distance determines an offset of said at least one heel with respect to the head of said needle along a direction that is substantially parallel to said actuation trajectory of the needle holder in the same direction as, or in the opposite direction to, the direction of actuation of the needle holder, and in that said at least one path is offset, in a manner that corresponds substantially to said offset, with respect to a path of actuation of an ideal rectilinear needle with its head in alignment with its at least one heel.

2. The machine according to claim 1, wherein two contiguous needles have corresponding heels which are mutually spaced parallel to their longitudinal extension, said heels being engageable with corresponding paths that are defined by said cams and mutually spaced along a direction that is substantially perpendicular to the actuation trajectory of the needle holder.

3. The machine according to claim 2, wherein said two contiguous needles are inserted in two contiguous knitting forming channels and their heels are offset with respect to the corresponding head respectively in the same direction as the actuation direction of the needle holder and in the opposite direction with respect to the actuation direction of the needle holder.

4. The machine according to claim 2, wherein said two contiguous needles are inserted in two contiguous knitting forming channels and their heels are offset with respect to the corresponding head, both in the same direction as the actuation direction of the needle holder, but with mutually different degrees of offset.

5. The machine according to claim 1, wherein at least some of said cams are mounted on a supporting element that can move on command with respect to remaining ones of said cams.

6. The machine according to claim 5, wherein said supporting element can move with respect to said remaining ones of said cams along a direction that is substantially parallel to the actuation trajectory of the needle holder.

7. The machine according to claim 1, wherein the number of said sliding channels is smaller than, or equal to, the number of said knitting forming channels.

* * * * *